United States Patent [19]

Nelson

[11] 4,449,755

[45] May 22, 1984

[54] THIN SEAM MINING MACHINE

[76] Inventor: Rodney L. Nelson, Box N, Falls Creek, Pa. 15840

[21] Appl. No.: 431,720

[22] Filed: Sep. 30, 1982

[51] Int. Cl.[3] ..... C21C 27/24

[52] U.S. Cl. ..... 299/31; 299/68; 299/71; 299/33

[58] Field of Search ..... 299/18, 64, 31, 33, 299/68, 71, 76, 78

[56] References Cited

U.S. PATENT DOCUMENTS

| | | | |
|---|---|---|---|
| 3,044,753 | 7/1962 | Wilcox, Jr. | 299/76 |
| 3,288,536 | 11/1966 | Galis et al. | 299/71 |
| 4,160,566 | 7/1979 | McGee | 299/30 |
| 4,181,360 | 1/1980 | Wilson | 299/1 |

FOREIGN PATENT DOCUMENTS

| | | | |
|---|---|---|---|
| 99024 | 8/1961 | Netherlands | 299/33 |
| 514952 | 9/1976 | U.S.S.R. . | |

*Primary Examiner*—William F. Pate, III

*Attorney, Agent, or Firm*—Brady, O'Boyle & Gates

[57] ABSTRACT

A low profile thin seam miner includes a main frame mounting a lower transverse axis rotary cutter and a parallel axis conveyor rearwardly of the lower cutter. The main frame also mounts a forward transverse axis rotary cutter somewhat above the lower cutter, the forward upper cutter being supported on a longitudinal boom pivoted to the main frame and being vertically swingable under influence of a single cylinder. The main frame and all of its parts is incrementally advanced into the seam by the alternating action of two horizontal longitudinal parallel axis cylinders connected between the main frame and a pair of floor-engaging plates. Two vertical axis jacks are connected between the two floor-engaging plates and two cooperating overhead roof plates, connected with the floor-engaging plates by separate toggle linkages. Two more generally upright cylinders connected between the floor plates and the rear of the main frame can tilt the main frame on a transverse pivot axis to vary the depth of cut of the lower rear cutter responsive to the control of a sensing tooth on such cutter. The single cylinder connected with the boom of the forward upper cutter can swing the boom on its transverse pivot axis to vary the depth of cut of the forward upper cutter, responsive to the control of a sensing tooth on such cutter.

14 Claims, 11 Drawing Figures

FIG.1
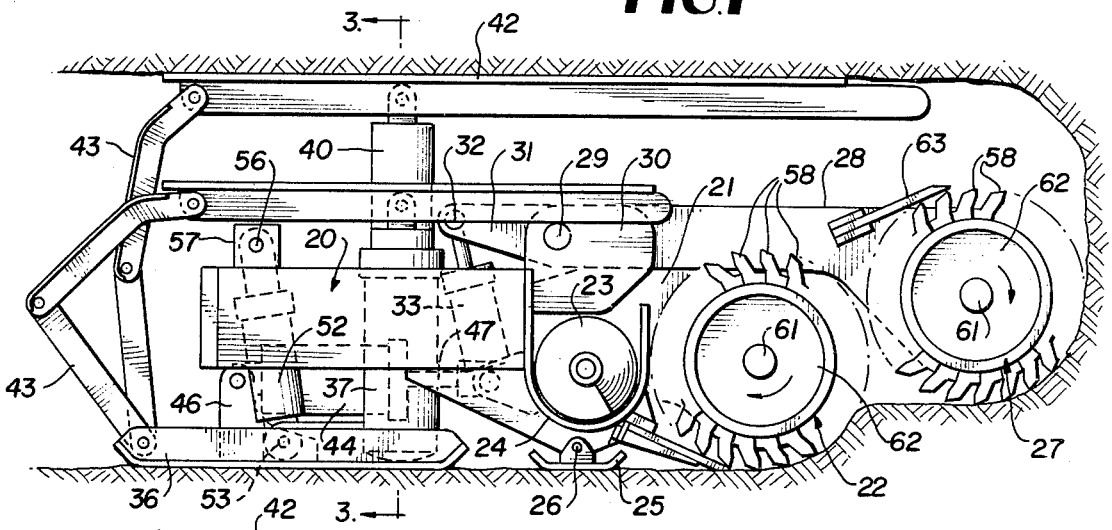
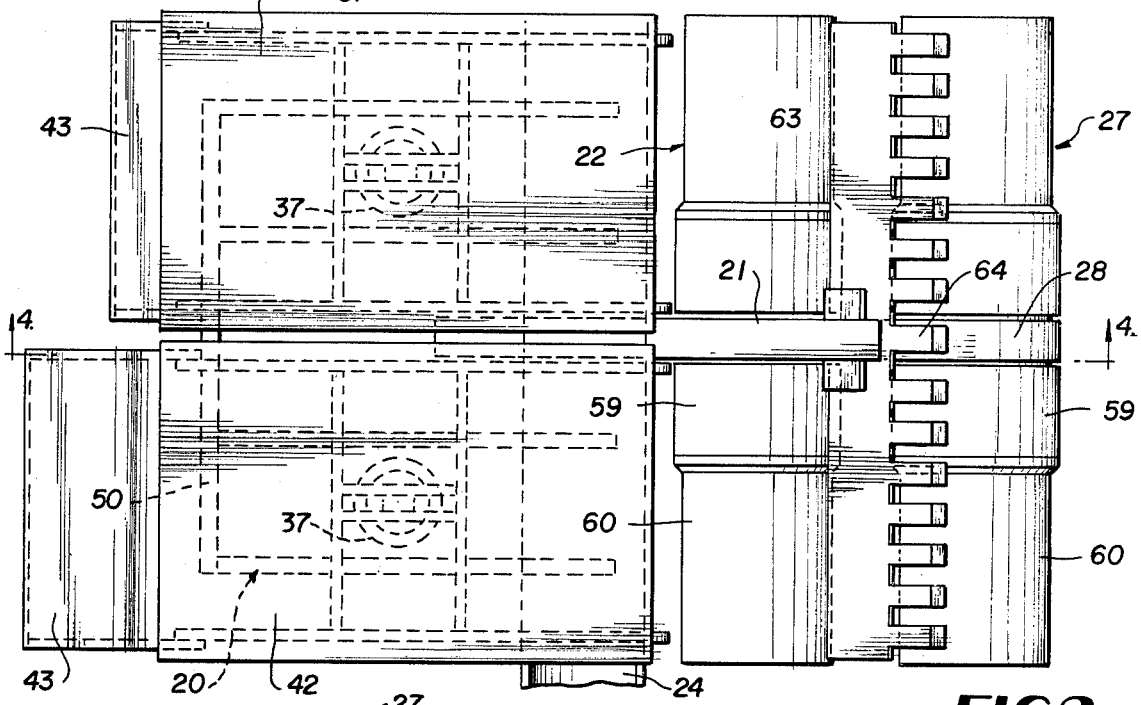
FIG.2
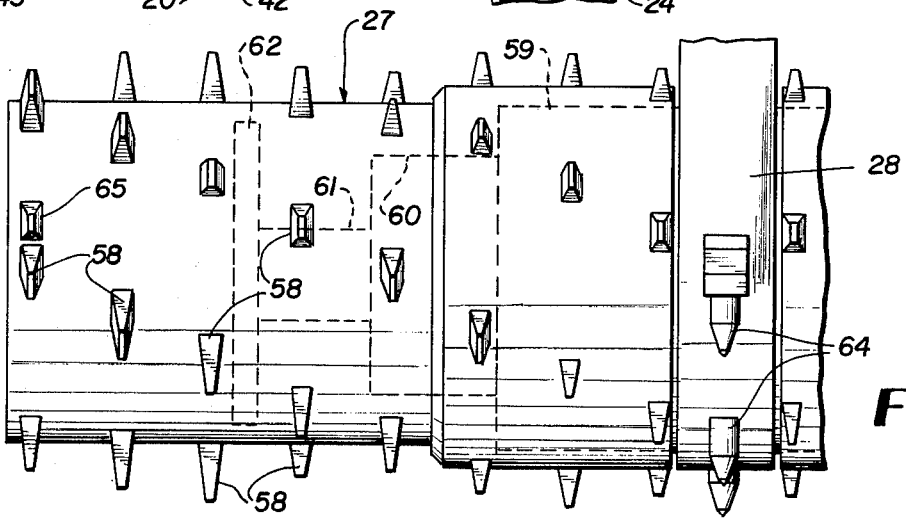
FIG.6

THIN SEAM MINING MACHINE

BACKGROUND OF THE INVENTION

This invention relates to a thin seam mining machine for coal or other minerals. More particularly, the machine is of the general type used in the surface mining of relatively thin seams which are accessible on the faces of natural hills or man-made hills created by surface trenching.

The general objective of the invention is to provide a thin seam miner embodying a number of improvements over the known , prior art, whereby, in terms of overall operation, the machine is more efficient, more practical, sturdier and possesses a higher mining capacity without increased manufacturing cost.

A further object of the invention is to provide a thin seam miner of simpler construction than the prior art, greater ruggedness and durability, and requiring less maintenance.

A further and more specific object of the invention is to provide a thin seam miner whose operating components are controlled and moved entirely by the coordinated action of a series of power cylinders, such as hydraulic cylinders, connected between the machine components in a unique manner.

Still another object is to provide a thin seam miner having increased ability to follow a seam under control of two sensors on the two rotary cutters of the machine which can be independently adjusted by the action of power cylinders.

Other features and advantages of the invention will become apparent during the course of the following description.

BRIEF DESCRIPTION OF THE DRAWINGS

FIG. 1 is a side elevation of a thin seam mining machine according to the invention depicting the use thereof.

FIG. 2 is a plan view of the machine shown in FIG. 1.

FIG. 6 is an enlarged fragmentary plan view of a rotary cutter and associated elements.

DETAILED DESCRIPTION

Figure 3:
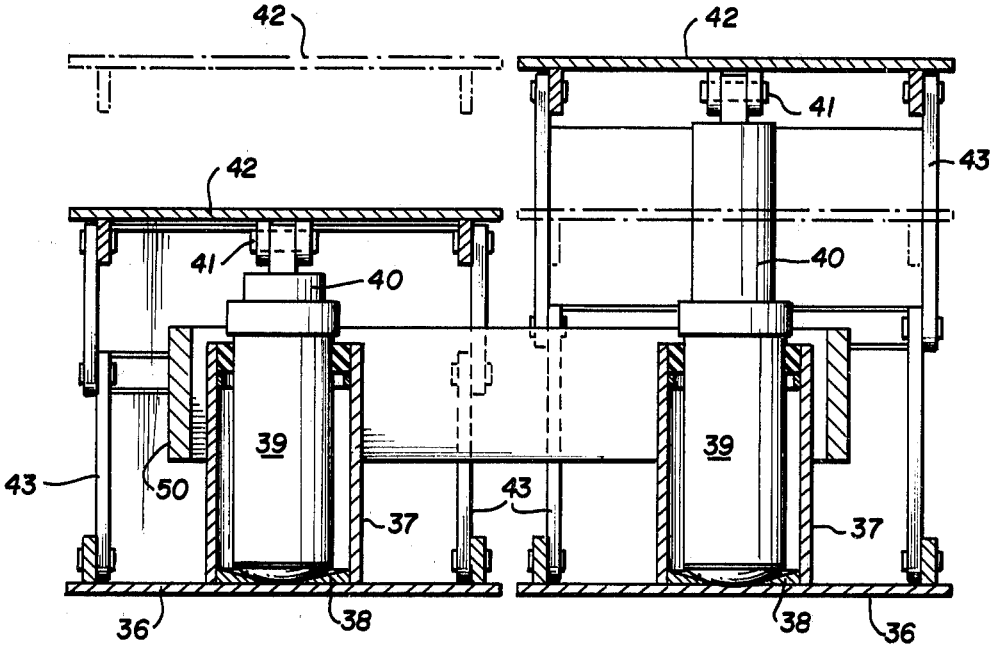
FIG. 3 is an enlarged transverse vertical section taken on line 3—3 of FIG. 1.
Figure 7:
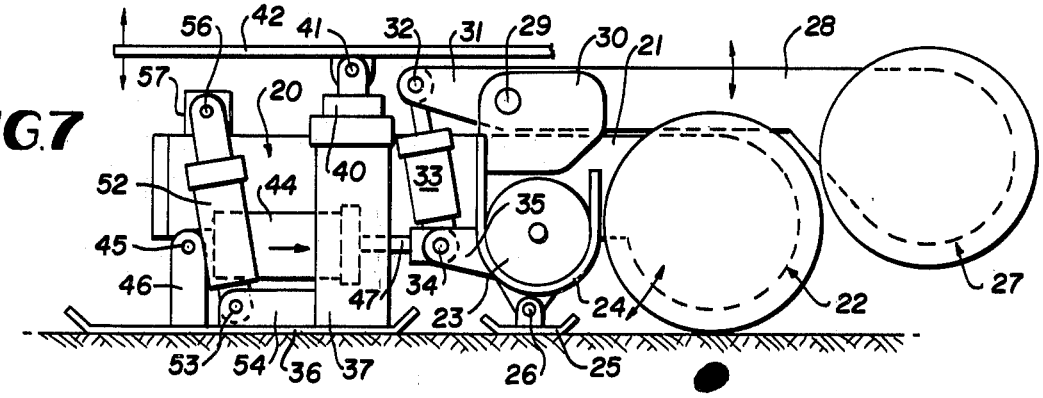
FIG. 7 is a schematic side elevation of the machine.

Referring to the drawings in detail, wherein like numerals designate like parts, a low profile thin seam mining machine comprises a substantially horizontal main frame 20 including a forward longitudinal boom extension 21 on which is mounted a lower rear transverse axis rotary cutter head 22.

Rearwardly of the cutter head 22 and mounted on the main frame 20 is a transverse axis auger conveyor 23 including a trough 24 to take away the coal or mineral cuttings. A floor-engaging pad 25 on the bottom of the conveyor trough lends support to the main frame 20 and its components, and this pad is in sliding contact with the floor of the seam being mined. The pad 25 is pivotally attached to the main frame 20 as at 26. Under certain circumstances, to be described, the main frame 20 and its directly mounted cutter head 22 can be rocked on the transverse axis of the pivot 26.

A forward upper transverse axis cutter head 27 is mounted on the forward end of a longitudinal boom 28 which is pivoted near its rear end upon a sturdy transverse axis pivot pin 29 attached to an extension 30 of the main frame 20 which projects above the main frame.

The extreme rear end portion 31 of the boom 28 behind the pivot pin 29 is connected as at 32 to a single generally upright hydraulic cylinder 33 whose lower end is pivotally anchored at 34 to a rigid lug 35 on the main frame 20. At proper times, the cylinder 33 can be actuated to swing the boom 28 vertically on its pivot 29.

Rearwardly of the cylinder 33 and conveyor 23, the machine comprises a pair of side-by-side separate flat horizontal floor-engaging plates 36. On the forward portions of these plates centrally are vertical axis support sleeves 37 whose lower ends are fixed to the plates. At their bottoms, the support sleeves contain seats 38, FIG. 3, for the cylinder bodies 39 of vertical axis hydraulic jacks or rams having alternately operable piston rods 40 whose upper ends are attached at 41 to a pair of side-by-side roof-engaging plates 42. The plates 42 and 36 are maintained in parallelism during the operation of the machine by rear toggle linkages 43 connected between the roof and floor plates 42 and 36, as shown in the drawings.

Figure 5:
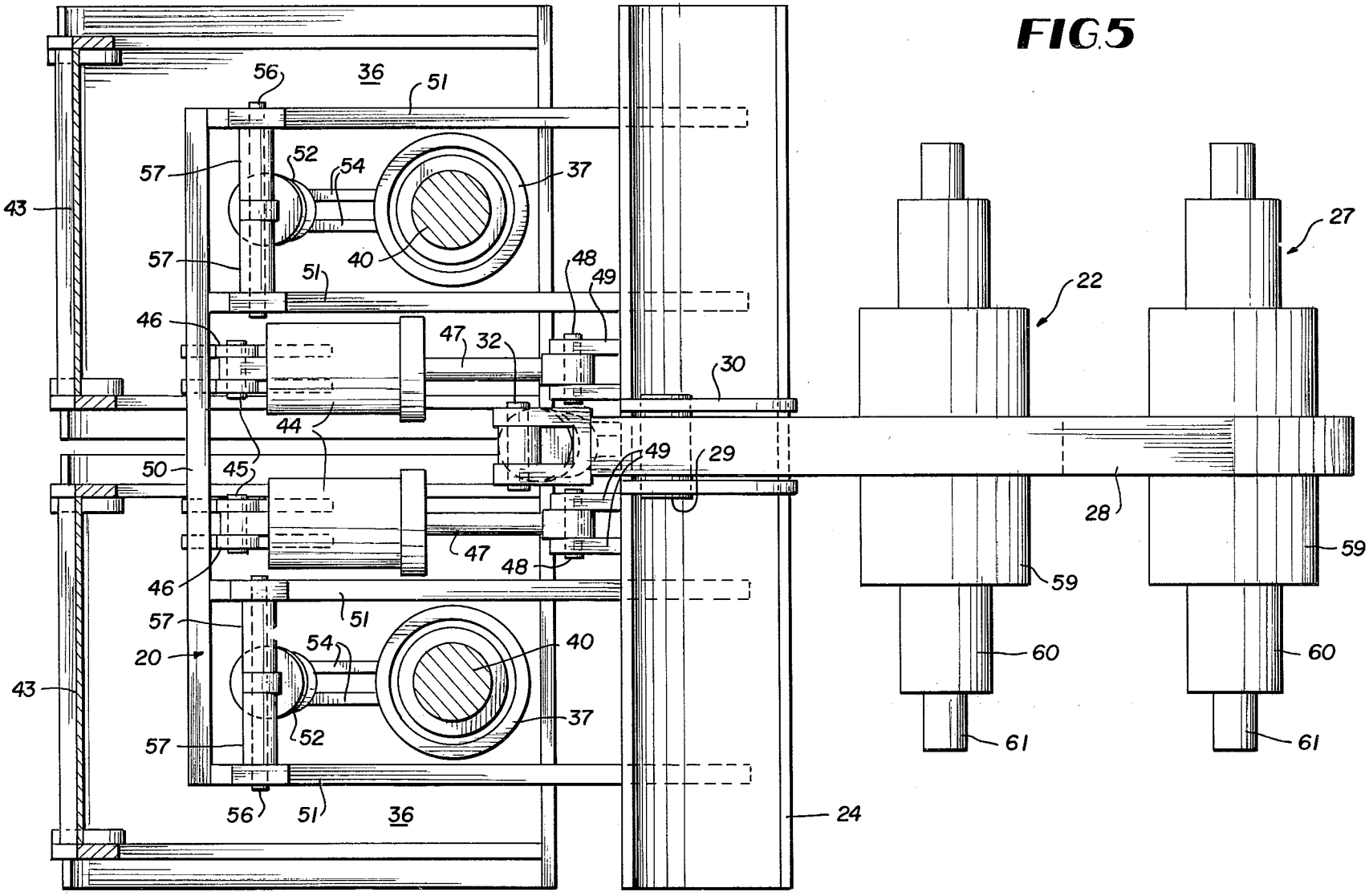
FIG. 5 is a horizontal section taken on line 5—5 of FIG. 4.

A pair of horizontal axis longitudinal side-by-side hydraulic cylinders 44 have their rear ends connected as at 45 to upstanding rigid lugs 46 rising from the floor plates 36 and fixed thereto. The rods 47 of cylinders 44 are attached through pins 48, FIG. 5, to fixed lugs 49 of the main frame 20, at the rear of conveyor trough 24.

The main frame 20 consists of a rear vertical wall 50 and two pairs of spaced parallel longitudinal forwardly extending webs 51. One pair of these webs, FIG. 5, straddles one of the upright support sleeves 37 so that the entire support frame may move longitudinally at proper times under influence of the cylinders 44 relative to the sleeves 37 and floor plates 36. The interior webs 51 also straddle the cylinders 44 with adequate spacing to allow necessary relative movement.

Another pair of generally upright axis hydraulic cylinders 52 have their lower ends anchored at 53 to webs 54 of the floor plates 36. The rods 55 of cylinders 52 are connected at 56 to rigid lugs 57 or plates of the main frame 20 at the top thereof.

At proper times during the operation of the mining machine, the cylinders 52 are operated to tilt the main frame 20 on the axis of pivot 26 to raise or lower the cutter head 22, as will be further described.

Each of the rotary cutter heads 22 and 27 comprises a multi-toothed structure having teeth 58 distributed as shown in the drawings. The directions of rotation of the two cutter heads are indicated by arrows in FIG. 1. The cutter heads are shown without teeth in FIGS. 2 and 5 for simplicity of illustration. They are self-contained units which preferably comprise hydraulic motors 59, transmissions 60 and drive spindles 61. Sleeves carrying the cutting teeth 58 are mounted over the housing of motors 59, FIG. 6, and are attached to plates 62 fixed on the spindles 61. To a great extent, the rotary cutter heads are state-of-the-art equipment and need not be further described.

A toothed ripper comb 63 is preferably fixed to the boom 28 of forward cutter head 27 and closely overlies the teeth of such cutter head as shown in FIGS. 1 and 2. Fixed teeth 64 may also be provided on the top and forward end portion of the boom 28, FIG. 6.

Figures 4, 10:
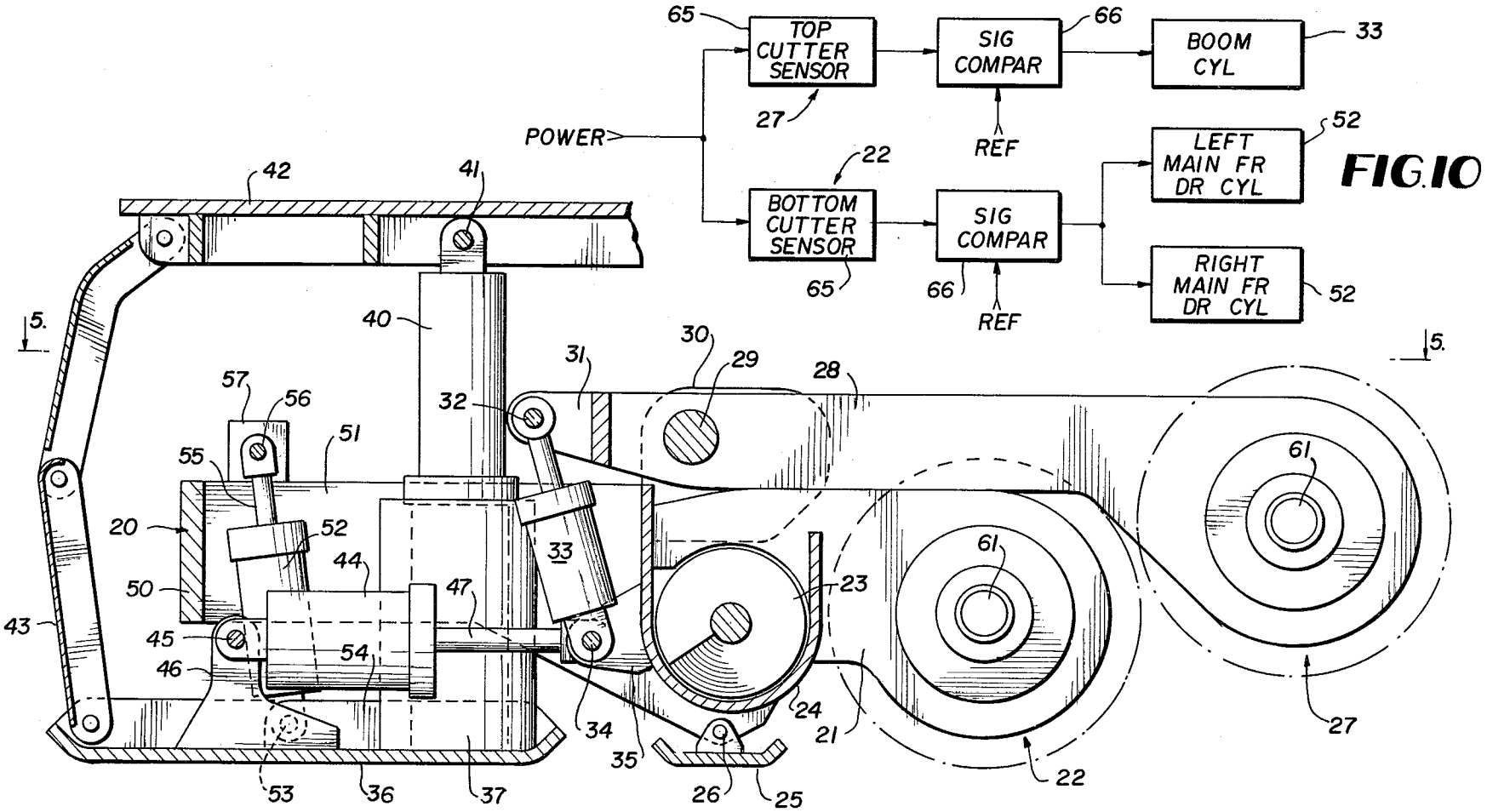
FIG. 4 is an enlarged longitudinal vertical section taken on line 4—4 of FIG. 2.
FIG. 10 is a schematic view of the control system for the machine.

As shown in FIG. 6, each cutter head 22 and 27 includes one state-of-the-art sensing tooth 65 preferably arranged immediately behind one cutting tooth 58 at one end of the cutter head. For example, the sensing tooth may be of the type shown in U.S. Pat. No. 4,181,360 or in U.S. Pat. No. 3,550,959. Such a sensing tooth serving as a load cell will produce a signal indicative of the material being cut by the cutter head at any given time, such as coal, soft clay or hard rock. Referring to FIG. 10, the sensing teeth 65 of the upper and lower cutter heads 27 and 22 are shown each sending a separate signal indicative of the material being sensed to respective signal comparators 66 having adjustable signal reference levels, the comparators comparing the signal level received against a set reference and delivering signals which control, respectively, the operation of the single cylinder 33 for top cutter head 27 and the pair of cylinders 52 which control the attitude of main frame 51.

The signals thus delivered to the conventional control means of cylinders 33 and 52 will cause these cylinders to position the boom 28 and frame 20 in their respective pivots 29 and 26 in such a manner that the two cutter heads 27 and 22 will follow and cut coal in the thin seam while avoiding the cutting of clay or rock. In this manner, the machine can discriminate between different mediums encountered by the rotary cutter heads and cut only the proper medium. The cylinders 33 and 52, and hence the heads 27 and 22 are separately and independently controlled by the sensing system. Consequently, in some cases, the boom 28 will be swung upwardly or downwardly with the head 27 on the pivot 29 while the lower head 22 remains in a relatively fixed position. In other cases, the cylinders 52 may tilt the main frame 20 one way or the other on the axis of pivot 26 to lower or raise both cutting heads 22 and 27 in unison. In still other cases, the two cutter heads will be caused to separate vertically or move downwardly different amounts by separate actuations of their control cylinders 33 and 52 dictated by the sensing teeth 65, one on each head.

When the mining machine is placed with its two rotary cutting heads in alignment with an exposed seam of coal on a hillside or within a trench, and after an initial recess or cut is made in the seam, sufficient for the machine to enter, the following sequence of operation occurs.

The drive motors of the two rotary cutter heads 27 and 22 are activated and the drive motor of auger conveyor 23 is activated, as well as pumping means, not shown, to pressurize the various hydraulic cylinders of the machine. One of the two hydraulic jacks 40 is extended to spread apart one opposing pair of plates 36 and 42, FIGS. 3 and 4, while the other jack 40 remains retracted. The separated plates 36 and 42 grip the floor and roof of the cavity and anchor the machine fixedly. The horizontal cylinder 44 connected with the expanded or active floor plate 36 is actuated and its rod 47 pushes the entire main frame 20 and all parts thereon forwardly which forces the rotating cutter heads 27 and 22 forwardly into the seam to mine coal or the like. The cuttings from the two counter-rotating heads 27 and 22 are fed rearwardly and enter the trough 24 having the auger 23 which propels the cuttings toward one side of the machine. While this advancing process is taking place, the above-described sensing system shown in FIG. 10 involving sensing teeth 65 is constantly adjusting the positions of the boom 28 and/or main frame 20 on their pivots 29 and 26. The pad or shoe 25 slides forwardly on the floor of the cavity during each advancement of the main frame 20 by one of the cylinders 44.

Following advancement by one cylinder 44, the other jack 40 is activated and extended to spread the other pair of plates 36 and 42 into gripping engagement with the floor and roof, and the previously-employed jack is retracted. The other cylinder 44 connected to the now-active floor plate 36 is actuated and its rod 47 advances the main frame 20 and both cutter heads 22 and 27 a further distance into the seam. During this advancement, the rod 47 of the other cylinder 44 associated with the inactive pair of plates 36 and 42 retracts, and this serves to pull the inactive pair of plates forwardly to the next position for continued step-by-step advancement of the machine.

Figure 8:
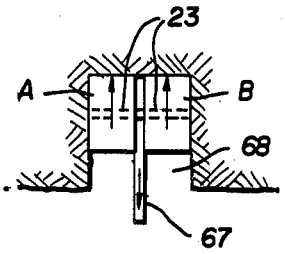
FIGS. 8 and 9 are schematic plan views depicting the use of plural machine modules for mining a thin seam.

In practice, as shown in FIG. 8, a pair of machine modules A and B in side-by-side relationship can be used to form an initial passageway into a hillside coal seam. The cuttings from this initial penetration are delivered onto a suitable takeaway conveyor 67 by the conveyors 23 of the two machine modules A and B, each of which modules is one complete machine of the type already described in full detail.

After formation of the initial cavity 68 in the seam by the two machine modules A and B to a desired depth, several machine modules A, B, C, D, E and F may be placed side-by-side in the cavity 68 with their auger conveyors 23 in registration to deliver mined coal outside of the seam as at 69. The group of machine modules A through F are then advanced longitudinally through the seam of coal until the seam is completely mined along its length. A single machine module or two or more modules up to any practical number may be employed in the manner described.

Figure 9:
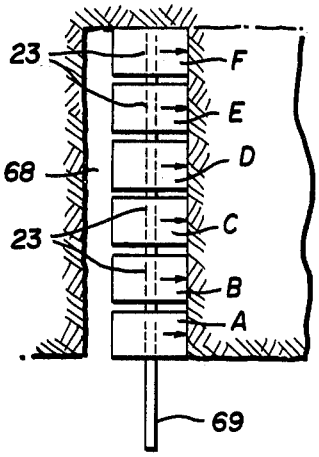
Figure 11:
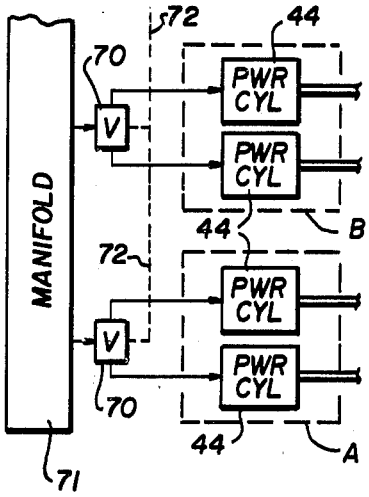
FIG. 11 is a fragmentary schematic view of a valved system for regulating the flow of pressurized fluid to propulsion cylinders of machine modules.

FIG. 11 shows schematically an arrangement for regulating the volume of flow into the alternately acting forward propulsion cylinders 44 of the machine modules A, B, C, etc., as shown in FIG. 9, so that these modules are caused to advance approximately in unison. For example, if one or more of the machine modules happens to encounter hard material, such as rock, its progress will tend to be slowed in relation to other modules of the gang which are encountering softer material, such as coal.

To compensate for this, the two cylinders 44 of each module A, B, C, etc. are connected with a fluid flow regulating valve 70, each such valve receiving fluid at a proper pressure from a fluid distribution manifold 71 common to the several regulator valves 70 of the system. The actuators of the valves 70 are interconnected by mechanical linkages 72 of a known type which can respond to retarded movement or excessive forward movement of individual machine modules and adjust the flow regulator valves 70 of adjacent modules, as required, to increase or decrease the flow of fluid to the cylinders 44 of those modules to even out their rate of advancement into the seam in spite of the fact that some modules may be encountering more resistance to advancement than others.

Another mode of operation of the modular machine, not shown in the drawings, is also enabled through the provision of the flow regulating valves 70 and linkages 72. The machine can be caused to pivot or swing around one end module, such as the module A, in an arcuate path centered on the module A, due to the ability of the valves 70 to regulate the flow of fluid at a constant pressure into the cylinders 44 of each module A, B, C, etc., up to eight or ten modules in a practical machine. The end module A forming the pivot point will have its valve 70 throttled to nearly zero advancement and successive modules B, C, etc. of the gang will be regulated through their valves 70 so that each will advance at a progressively greater rate into the seam. The far endmost module, such as module F, FIG. 9, will have no restraint linkage acting on its valve 70 and therefore can advance at full speed, whereby the gang of modules will be able to travel on an arcuate path while remaining substantially in side-by-side alignment. Therefore, control of the rate of flow of hydraulic fluid to the propulsion cylinders 44 becomes vital in achieving the desired modes of operation of a mining machine consisting of a gang or string of machine modules according to the invention.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A thin seam mining machine comprising a main frame having a forward boom extension, a first rotary cutter head on said boom extension, a cross conveyor for cuttings on the main frame rearward of the first rotary cutter head, the main frame having a transverse axis fulcrum, a boom pivotally mounted upon the main frame for vertical swinging on a transverse pivot axis and projecting forwardly of said boom extension, a second rotary cutter head on said boom in advance of the first rotary cutter head and somewhat above the latter, the first and second rotary cutter heads counterrotating in the operation of the machine to deliver cuttings to said conveyor, a power cylinder connected between the rear end of said boom and said main frame rearward of the boom pivot and being operable to swing the boom on its pivot, at least a power cylinder connected with the main frame rearward of the fulcrum and being operable to rock the main frame on said fulcrum, side-by-side pairs of connected floor and roof engaging plates disposed above and below the main frame and rearward of the first and second rotary cutter heads, alternately operating jacks connected between the pairs of floor and roof engaging plates to expand and retract the pairs of plates alternately, and a pair of parallel longitudinal axis side-by-side power cylinders connected between the floor engaging plates of the pairs and the main frame and being alternately operable in timed relationship with the operation of said jacks to advance the main frame into a seam and to pull forwardly the inactive pair of floor and roof engaging plates preparatory to another advancement of the main frame.

2. A thin seam mining machine as defined in claim 1, and said at least a power cylinder connected with the main frame consisting of a pair of power cylinders connected between the main frame and the floor engaging plates of said pairs.

3. A thin seam mining machine as defined in claim 2, and a control system for the first and second rotary cutter heads of the machine including a sensing element on each head sensing a particular medium being cut by each head and delivering a control signal to control means for said power cylinder connected between the rear of said boom and said main frame and to the pair of cylinders connected between the main frame and the floor engaging plates.

4. A thin seam mining machine as defined in claim 1, and said side-by-side pairs of floor and roof engaging plates being connected at their rear ends by a pair of toggle linkages whereby the plates of the pairs are maintained parallel.

5. A thin seam mining machine as defined in claim 1, and said cross conveyor comprising an auger conveyor adapted to deliver cuttings to one side of the mining machine.

6. A thin seam mining machine as defined in claim 3, and each rotary cutter head comprising a multi-toothed head and one tooth on each head comprising said sensing element.

7. A thin seam mining machine as defined in claim 1, and said fulcrum consisting of a pivoted floor engaging shoe on the bottom of the main frame rearwardly of the first rotary cutter head.

8. A thin seam mining machine comprising a main frame having a floor engaging sliding shoe forming a fulcrum for the main frame on an axis across the main frame, a first rotary cutter head on the forward end of the main frame ahead of said fulcrum, a first sensor element on the first rotary cutter head producing a signal representative of material being cut by the first rotary cutter head, a boom pivotally mounted upon the main frame on a transverse axis pivot and extending forwardly of the first rotary cutter head, the second rotary cutter head on the forward end of the boom somewhat above and in advance of the first rotary cutter head, a second sensor element on the second rotary cutter head producing a signal representative of material being cut by the second rotary cutter head, a power cylinder connected between said boom and main frame and operating in response to the signal produced by the second sensor element to move said boom and second rotary cutter head on the pivot of the boom, another power cylinder connected with the main frame on one side of said fulcrum and operating in response to the signal produced by the first sensor element to move the main frame and first rotary cutter head on said fulcrum, means to form an anchor with walls of a cavity within which the machine is operating, and power means connected between said anchor and said main frame to advance the main frame through a seam being mined by the machine.

9. A thin seam mining machine as defined in claim 8, and said means to form an anchor comprising laterally spaced pairs of floor and roof engaging plates below and above the main frame, alternately operable power jacks connected between said pairs of plates, and alternately operable power cylinders connected between corresponding plates of the pairs and the main frame to incrementally advance the main frame with the first and second rotary cutter heads into a seam.

10. A thin seam mining machine as defined in claim 9, and the alternately operable power cylinders being substantially horizontal power cylinders connected between the floor engaging plates of the pairs and said main frame.

11. A thin seam mining machine as defined in claim 9, and the main frame including spaced pairs of longitudinally extending webs straddling said jacks for relative movement.

12. A thin seam mining machine as defined in claim 8, and said another power cylinder being connected between the main frame and a part of said means forming said anchor.

13. A thin seam mining machine comprising a plurality of mining machine modules each constructed in accordance with claim 8 and arranged in side-by-side relationship, and regulator means connected with said power means and being operable to control the rate of advancement of each individual machine module through a seam in response to the degree of resistance to advancement offered by the seam at a given locality.

14. A thin seam mining machine comprising a plurality of mining machine modules each constructed in accordance with claim 1 and arranged in side-by-side relationship, and fluid flow regulator valves connected with the pair of parallel longitudinal axis power cylinders which operate alternately to advance the main frame into a seam, a fluid distribution manifold common to said regulator valves and connected therewith to supply fluid at a required operating pressure to the valves, and mechanical means interconnecting the regulator valves to vary the flow of fluid from the manifold through the valves to said power cylinders in response to varying degrees of resistance to advancement of the machine modules encountered in a seam.

* * * * *